United States Patent [19]

Namgyal et al.

[11] Patent Number: 4,805,776

[45] Date of Patent: Feb. 21, 1989

[54] AIR CASE

[75] Inventors: Champa Namgyal, Co. Cork, Ireland; Robert Weinreb, New York, N.Y.

[73] Assignee: Tenba, Inc., New York, N.Y.

[21] Appl. No.: 112,093

[22] Filed: Oct. 21, 1987

[51] Int. Cl.[4] ..... B65D 85/30

[52] U.S. Cl. ..... 206/523; 383/110; 383/97; 220/902

[58] Field of Search ..... 206/523, 524; 150/127, 150/52 J; 220/902; 383/97, 109, 110

[56] References Cited

U.S. PATENT DOCUMENTS

| | | | |
|---|---|---|---|
| 2,123,031 | 7/1938 | Weiner | 383/110 X |
| 3,031,121 | 4/1962 | Chase | 220/902 X |
| 3,120,319 | 2/1964 | Buddrus | 220/902 X |
| 3,181,693 | 5/1965 | Freistat | 206/523 |
| 3,345,245 | 10/1967 | Hanusa | 206/524 |
| 3,420,363 | 1/1969 | Blickensderfer | 206/524 |
| 3,903,944 | 9/1975 | Montgomery et al. | 383/97 X |
| 3,948,436 | 4/1976 | Bambara | 206/523 X |
| 4,093,010 | 6/1978 | Hunley | 150/52 J |
| 4,106,597 | 8/1978 | Shook | 206/545 X |
| 4,267,927 | 5/1981 | English, Jr. | 206/524 |
| 4,339,039 | 7/1982 | Mykleby | 206/523 |
| 4,402,355 | 9/1983 | Wymore | 150/52 R |
| 4,433,781 | 2/1984 | Hummel | 206/523 X |
| 4,446,900 | 5/1984 | Markovich | 150/52 R |
| 4,463,789 | 8/1984 | Leiserson | 150/52 J |
| 4,537,313 | 8/1985 | Workman | 383/110 X |
| 4,545,414 | 10/1985 | Baum | 150/52 J |
| 4,598,746 | 7/1986 | Rabinowitz | 383/110 X |
| 4,610,286 | 9/1986 | Cyr | 150/52 J |
| 4,620,579 | 11/1986 | Lowe et al. | 206/523 X |
| 4,679,242 | 7/1987 | Brockhaus | 383/110 X |
| 4,733,806 | 3/1988 | Sloop | 206/523 X |

FOREIGN PATENT DOCUMENTS

| | | | |
|---|---|---|---|
| 3225842 | 2/1984 | Fed. Rep. of Germany | 206/523 |
| 1153034 | 9/1957 | France | 383/110 |
| 1009156 | 11/1965 | United Kingdom | 206/523 |
| 2102765 | 2/1983 | United Kingdom | 383/110 |

*Primary Examiner*—William Price

*Attorney, Agent, or Firm*—Jacobs & Jacobs

[57] ABSTRACT

An air case has a plurality of wall portions defining an enclosed internal region of the case in a closed condition thereof, each wall portion having a first layer of a rigid material having surface regions spaced apart by internal webs or ribs and a second layer of a shock absorbing resilient material, the layers being bonded together in a substantially unitary structure.

13 Claims, 3 Drawing Sheets

AIR CASE

This invention relates to air cases. Air cases are containers for accommodating delicate equipment during shipping and are designed to protect such equipment from damage during loading and transport. Traditionally, air cases have been of the so-called hardshell kind, fabricated from metal, plywood and fiberglass in a layered construction. While a high level of protection is afforded by a hardshell case, this is obtained at the cost of substantial weight penalty.

It is an object of the invention to provide an air case of light weight which nonetheless provides protection substantially equal to that given by a hardshell case.

According to the invention, there is provided an air case having a plurality of wall portions defining an enclosed internal region of the case in a closed condition thereof, wherein each wall portion is formed from a first layer of a material having surface regions spaced apart by internal webs or ribs and a second layer of a foamed material, said layers being bonded together in a substantially unitary structure.

Preferably, the surface regions of the first layer are substantially parallel and are separated by internal air spaces. The first layer may be of either corrugated or honeycomb construction. It is suitably formed from corrugated polyethylene, thereby giving a light, strong and rigid construction.

The second layer is a shock-absorbing resilient layer, preferably formed from dense cross-linked foam, for example polyethylene rubber foam. Alternatively, an open-cell foam may be used. In this latter case, the thickness of the foam layer is greater than applies when a denser foam is used. The lighter foam may be favored where enhanced shock absorbency may be desired.

In an air case in accordance with the invention, the first layer is preferably an outer layer, while the second layer is an inner layer of each wall portion. In a favored construction, the exterior of the walls of the air case is covered over by a cloth laminate, referred to in the trade as ballistics cloth. Suitably, an internal cloth lining is also provided within the air case.

A typical air case in accordance with the invention is constructed from six wall portions, each of layered configuration in accordance with the invention. Five of these wall portions are bonded together, while the sixth is hingedly associated with one of the side wall portions to open and close the container. The end faces of the four boundary walls terminating at the opening of the air case are sealed off at their free ends by a substantially rigid closure or gasket, which is preferably of channel section and may be either injection moulded or extruded. This channel section end face member or gasket engages over the wall portions, each limb of the channel lapping over the faces of the wall portions. The web of the channel then lies against the end face of the wall portion.

The outer cloth layer may be melt applied to the hot material of the outer layer during formation of the wall portion. The resulting completed structure is of very light weight, relative to hardshell cases. It may be provided in a multiplicity of configurations, and internal dividers of laminated material similar to that of the wall portions may be located at any required position within the container, to subdivide the interior of it for required purpose.

A typical air case in accordance with the invention is approximately one-quarter the weight of a comparable hardshell case. Nonetheless an air case in accordance with the invention may carry between 10 and 20 times its own weight in equipment. There is thus a considerable saving in gross shipping weight, while the actual manipulation and carriage of the air case in accordance with the invention is greatly eased compared with hardshell cases. Air cases in accordance with the invention meet accepted standards in the industry for trip durability, drop, vibrations and water damage. Air cases in accordance with the invention also transmit only relatively small levels of force, compared with hardshell cases. Despite its light weight and shock-absorbing capabilities, the air case in accordance with the invention is substantially rigid, even when empty, to the extent that it may support substantial weights without deformation. The combination of the rigidity of the corrugated or honeycombed material with the shock-absorbing features of the foam layer gives the air case of the invention these desirable characteristics. Further rigidity is provided by the rigid gasket or inverted channel of high impact nylon arranged around the tops of the sides of the case. A similar rigid gasket is suitably applied to the upper ends of any fixed dividers provided within the case of the invention.

The invention is illustrated in terms of its preferred embodiments in the accompanying drawings, in which.

Figure 1:
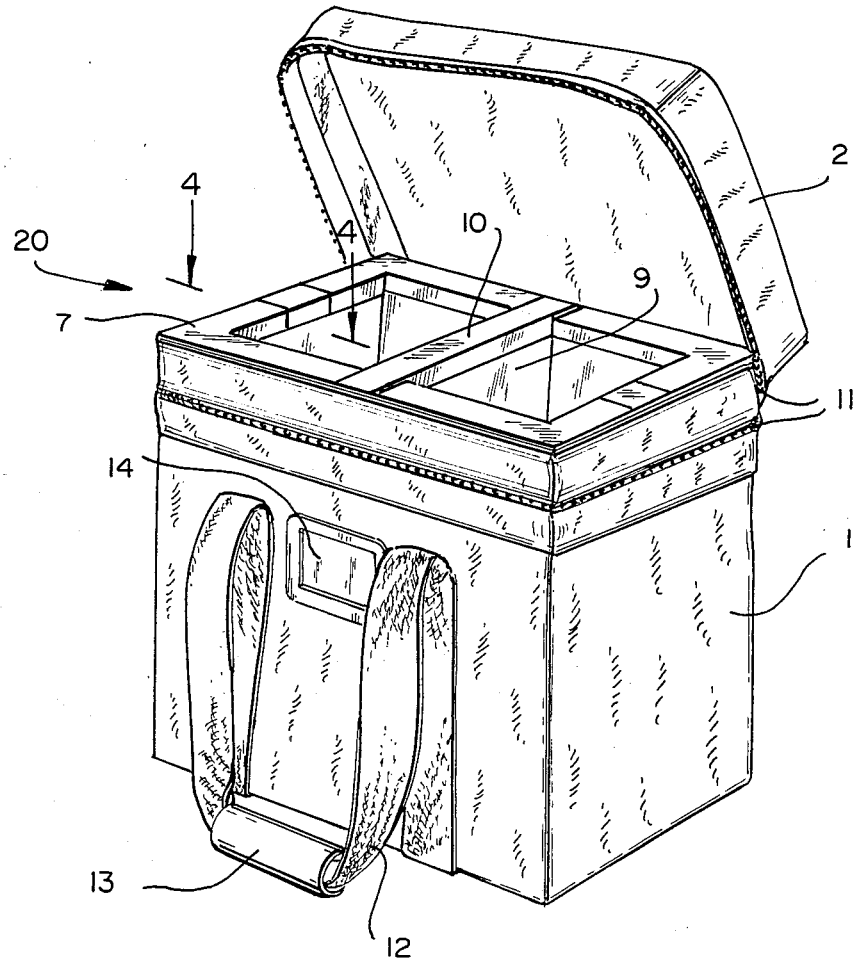
FIG. 1 is a perspective view of an air case in accordance with the invention.
Figure 2:
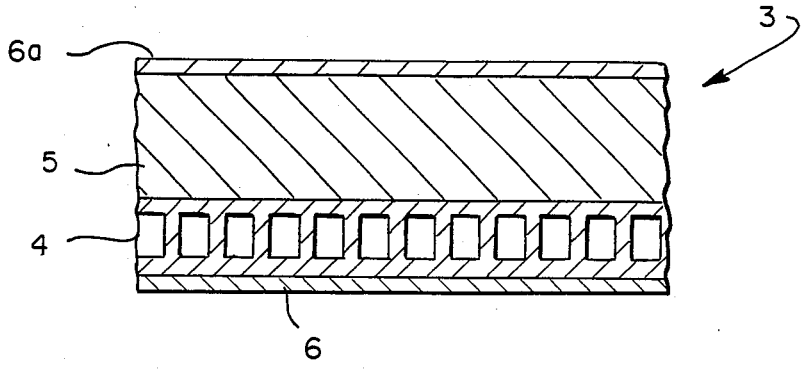
FIG. 2 is a detail view, in section, of a layered bottom wall portion of an air case in accordance with FIG. 1.
Figure 3:
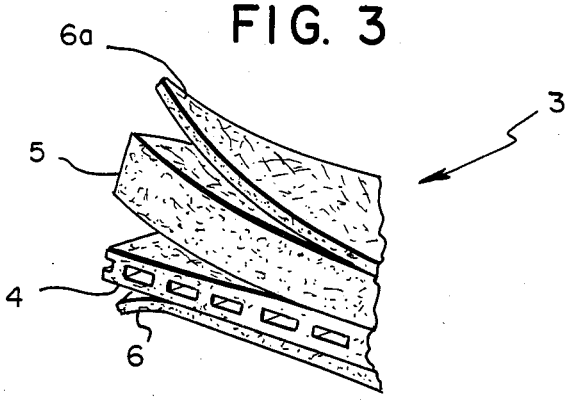
FIG. 3 is a perspective view of a layered wall portion of an air case in accordance with the invention, with layers partially peeled apart for clarity.

As shown in FIG. 1, an air case 20 in accordance with the invention has four side walls 1, a hinged lid or top wall 2 and a bottom wall 3 (FIGS. 2 and 3). Each wall 1,2,3 is of the same layered construction shown in FIGS. 2 and 3 for bottom wall 3. As will be seen from FIGS. 2 and 3, the bottom wall portion 3 has an outer layer 4 of rigid cellular material, such as corrugated polyethylene, and an inner resilient layer 5, bonded to the outer layer 4, such as cross-linked polyethylene rubber foam. The outer surface of the wall portion 3 is covered over by a tough cloth material 6, referred to as ballistics cloth, which forms an outer shell of the air case and protects the material of the air case against abrasion and sharp objects, and also gives it a good appearance. An inner lining *6a* is preferably used for protection of resilient layer 5 and for a good appearance.

Figure 4:
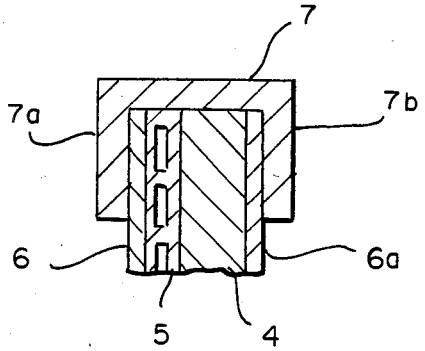
FIG. 4 is a detail view, in section, taken along lines 4—4 of FIG. 1.

The upper free ends of the side walls 1, which terminate at the opening of the air case where the hinged lid 2 is located, are covered over by a rigid, high impact nylon top gasket 7, which is suitably of inverted U-shaped channel configuration as seen in FIG. 4. The outer limb *7a* of the gasket 7 overlies the exterior cloth covered surface 6 of the wall portions 1, while the inner limb or leg *7b* of the gasket 7 overlies the inner lining *6a*. The inner lining *6a* may be a cloth material of lighter quality than the cloth material 6 covering the exterior. The rigid nylon gasket 7 provides additional rigidity in the air case and also protects the top edges of the walls 1 as the contents of the case are inserted and removed.

As will also be seen in FIG. 1, a central divider 9 is provided in the particular configuration illustrated, and a top gasket member 10 of the same construction as gasket 7 also closes off the end face of divider. Divider 9 may be a simple one-layer wall or may be of the same construction as walls 1,2 and 3.

Other features of the air case of FIG. 1 are that the top wall 2 of the container, i.e. that which is hinged to the integral lower structure, is also formed from the same laminated or layered material as walls 1 and 3. An inner lining 6*a* of a 430 denier nylon pack cloth protects the foam material 5 from sharp edges, protrusions and the contents. A coil zipper 11 is used to facilitate secure the closure of the air case 20, and it may be provided with two lockable sliders (not shown).

All stitching, including the stitching of the zippers 11 to the cloth, is carried out with strong tough bonded nylon thread such as is used in stitching boots. Hand straps 12 of suitable nylon webbing go around the bottom 3 of the air case 20 twice for extra security. The hand straps 12 are angled where attached to the air case 20 to reduce the stress at stitching points, in particular on long versions of the air case. A leather handgrip 13 going around the strap 12 may be provided, suitably padded with a cushioned rubber tube. Long models of the air case in accordance with the invention may have end hand straps and extra webbing at the bottom (not shown) to protect the cloth from scuffing. The exterior of the air case 20 may also be provided with an identification leather holder 14.

Figure 5A:
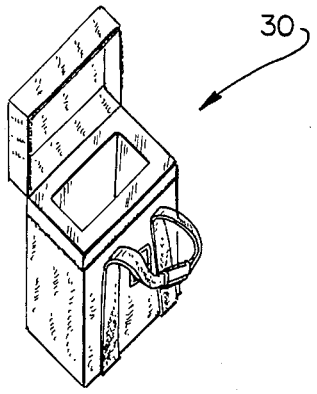
FIGS. 5A to 5D are perspective views showing a variety of configurations of air cases in accordance with the invention.
Figure 5B:
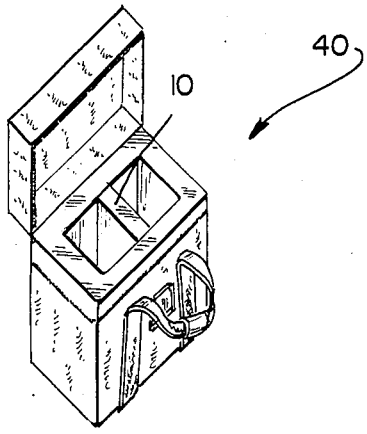

The air case in accordance with the invention may be provided in a variety of configurations, a number of which are shown by way of example in FIGS. 5A to 5D. FIG. 5A shows an air case 30 having no internal dividers. The air case 40 of FIG. 5B has a single central fixed divider 10. Dividers of this kind preferably are formed from double sided layered material, having a central layer of corrugated plastics (such as layer 4) and a foam layer (such as layer 5) to each side of this central corrugated portion. Thus full protection is afforded to contents of the air case in either of its two compartments.

Figure 5C:
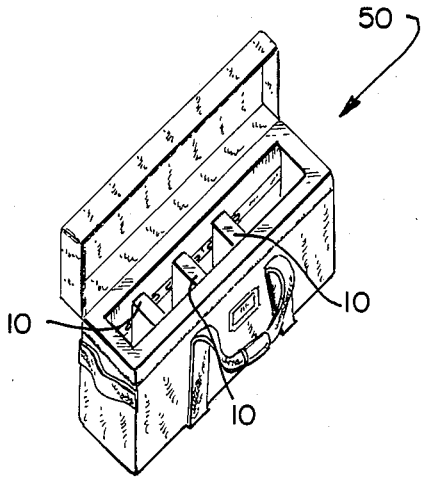
Figure 5D:
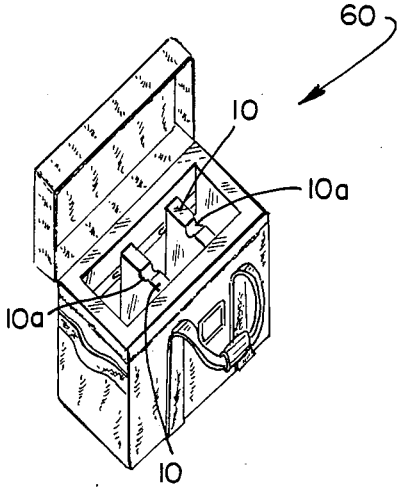

In the arrangement shown in FIG. 5C, the air case 50 has movable dividers 10, each of which terminates below the top opening of the case, to allow placement of long articles. The air case 60 of FIG. 5D provides movable dividers 10 located below the top opening of the case, the dividers 10 having monorail grooving 10*a* to accommodate elongated objects requiring locational restraint within the air case.

We claim:

1. An air case for accommodating equipment during shipment of said equipment, which comprises a plurality of rigid, shock-absorbing wall portions defining an enclosed internal region of said air case in a closed condition thereof, each wall portion having a first layer of a rigid material comprising honeycomb or corrugated plastic having surface regions spaced apart by internal webs or ribs and a second layer of shock-absorbing resilient material, said layers being bonded together in a substantially unitary structure and said rigid, shock-absorbing wall portions being operable to protect equipment from damage during shipment of said air case having said equipment stored in said internal region thereof.

2. The air case according to claim 1, wherein said surface regions of said first layer are substantially parallel and are separated by internal air spaces.

3. The air case according to claim 2, wherein said first layer is corrugated plastic.

4. The air case according to claim 3, wherein said first layer is corrugated polyethylene.

5. The air case according to claim 1, wherein said second layer is dense cross-linked foam.

6. The air case according to claim 5, wherein said foam is cross-linked polyethylene rubber foam.

7. The air case according to claim 1, wherein said second layer is an open cell foam.

8. The air case according to claim 1, wherein said first layer is an outer layer and said second layer is an inner layer of each said wall portion.

9. The air case according to claim 8, wherein the exterior of said wall portions is covered by cloth.

10. The air case according to claim 1, wherein a cloth lining is provided on the inner layers of said wall portions.

11. The air case according to claim 1, having six said wall portions, five of which are connected together to form a bottom wall portion and four side wall portions, thereby defining an open-ended enclosure, and the sixth wall portion is hingedly connected to one of the side wall portions for opening and closing the air case.

12. The air case according to claim 11, wherein the end faces of the four side walls terminate at the opening of the air case in free ends, and a substantially rigid gasket seals said free ends.

13. The air case according to claim 12, wherein said gasket is an inverted U-shaped channel section, each limb of said gasket lapping over the faces of said side wall portions and the web of said gasket lying against the free ends of said side wall portions.

* * * * *